US007371495B2

(12) United States Patent
Sato

(10) Patent No.: US 7,371,495 B2
(45) Date of Patent: May 13, 2008

(54) TONER

(75) Inventor: Shuitsu Sato, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 408 days.

(21) Appl. No.: 11/079,197

(22) Filed: Mar. 15, 2005

(65) Prior Publication Data

US 2006/0210900 A1 Sep. 21, 2006

(51) Int. Cl.
*G03G 9/08* (2006.01)

(52) U.S. Cl. ..... 430/108.1; 430/108.23; 430/108.3; 430/108.4; 430/108.6; 430/111.4

(58) Field of Classification Search ..... 430/108.1, 430/108.23, 108.3, 108.4, 108.6, 111.4
See application file for complete search history.

(56) References Cited

U.S. PATENT DOCUMENTS

| | | | | |
|---|---|---|---|---|
| 2,297,691 | A | 10/1942 | Carlson | |
| 5,981,129 | A * | 11/1999 | Akazawa et al. | 430/110.2 |
| 6,348,291 | B1 | 2/2002 | Sato | |

FOREIGN PATENT DOCUMENTS

| | | | |
|---|---|---|---|
| JP | 42-23910 | | 11/1967 |
| JP | 43-24748 | | 10/1968 |
| JP | 6-258863 | A | 9/1994 |
| JP | 2002-72544 | A | 3/2002 |
| JP | 2002-148846 | A | 5/2002 |
| JP | 2003-270838 | A | 9/2003 |

OTHER PUBLICATIONS

Machine translation of JP 2003-270838.*
U.S. Appl. No. 08/202,176, filed Feb. 25, 1994, Sato et al.
Translation of claims of JP 2003-270838, 2 pgs.

* cited by examiner

*Primary Examiner*—Mark A. Chapman
(74) *Attorney, Agent, or Firm*—Foley & Lardner LLP

(57) ABSTRACT

A toner is formed of toner particles including a polyester resin as a principal component, and at least a colorant and a charge control agent, and externally added inorganic fine particles and organic fine particles. The toner has a volume-average diameter of 4 to 10 μm, contains the charge control agent at 0.1 to 1.5%, and has an acid value of 2 to 33 mgKOH/g. The charge control agent exhibits a number-basis isolation percentage of at most 10% with respect to the toner particle. The charge control agent, the inorganic fine particles and organic fine particles exhibit number-basis isolation percentages from the toner particles satisfying a following relationship: 30%>inorganic fine particles>organic fine particles>charge control agent>0%.

20 Claims, No Drawings

TONER

BACKGROUND OF THE INVENTION

1. Field of the Invention

The present invention relates to a toner for developing electrostatic images in electrophotography, electrostatic recording, electrostatic printing, etc., or a toner for image formation according to a toner jetting scheme.

2. Related Background Art

Hitherto, it has been well known to form an electrostatic latent image on the surface of an electroconductive material by electrostatic means and developing the latent image with a toner. There have been known many methods, as disclosed in, e.g., U.S. Pat. No. 2,297,691; Japanese Patent Publication (JP-B) 42-23910 and JP-B 43-24748. Generally, an electrostatic latent image is formed on a photosensitive member utilizing a photoconductor material by various means, and then an extremely finely pulverized electrosensitive material called "toner" is attached onto the latent image, thereby forming a toner image corresponding to the electrostatic latent image. Then, the toner image is transferred onto an image supporting member (or transfer material) such as paper, according to necessity and fixed by heating, pressurization or with solvent vapor to form a copy product. In the case of including such a transfer step, a further step for removing residual toner is ordinarily provided.

Toners used in image forming methods as described above, are charged to prescribed quantity and polarity by friction with a carrier in the case of a two-component developer comprising a toner and a carrier, or by friction with a charge-imparting member in the case of a mono-component developer consisting only of a toner, and are caused to develop electrostatic latent images by utilizing an electrostatic attractive force. In order to stabilize the chargeability, an organo-metal complex, such as an azo-type metal complex or a metal complex of an alkyl-substituted salicylic acid, is used as a charge control gent, whereas the releasability of such a charge control agent at the toner surface layer is liable to lower the environmental stability of the toner, thus resulting in non-uniform toner charges, lower the chargeability with time and cause toner scattering and ground soiling. Further, the released charge control agent is attached to a developer-carrying and conveying member to cause a degradation, thus failing to provide a sufficient durability.

Further, if a toner as a developer used in the above-mentioned image forming method consists only of mother toner particles comprising a resin, a colorant and a charge control agent, it cannot exhibit sufficient performances, such as flowability, transferability and developing performance. Accordingly, in order to improve these performances, it has been practiced to add, to the toner particles, external additives inclusive of fine particles of inorganic oxides, such as silica, titania or alumina, or organic fine particles of metallic soap, etc., functioning as an external lubricant. Generally, the addition of an inorganic oxide such as silica provides an improved flowability and a good chargeability characteristic, but the additive in an isolated form without being attached to the mother toner particles is liable to be attached to the developer-carrying member or the latent image-supporting member, thereby causing developing irregularities, such as a filming phenomenon. Further, even if the additive is uniformly attached to the toner particles, the state of presence of the additive in the toner is liable to vary with time, so that the additive is embedded within the toner particles or released from the toner particles to gradually increase the percentage of isolated additive. As a result, the flowability becomes worse with time to result in non-uniform toner chargeability and lowering in chargeability with time, thus causing toner scattering or an increase of ground soil. Further, the isolated additive is liable to be attached to the developer-carrying member and the latent image-supporting member, thereby causing developing irregularities, such as filming, and failing to provide a sufficient durability.

For overcoming the above-mentioned problems, many studies have been made. For example, Japanese Laid-Open Patent Appln. (JP-A) 2002-72544 discloses an electrostatic image-developing toner comprising toner particles containing a binder resin and a colorant, and external additives including titanium oxide fine particles and silica fine particles with a specific number-basis isolated percentage on the toner particle surfaces. Further, JP-A 2003-270838 discloses a toner comprising at least a binder resin, a colorant, a charge control agent and inorganic fine particles; the binder resin comprising a polyester resin as a principal component and having an acid value of 2.0 to 50.0 mgKOH/g, and the number-basis isolation percentage of the charge control agent with respect to the toner particles being 0.01%-10.0%, and the JP-A reference also refers to the metal species of the charge control agent and the number-basis isolation percentage of the inorganic fine particles. However, these preceding references have given consideration to only the number-basis isolation percentage of inorganic fine particles or inorganic fine particles and charge control agent isolated from toner particles in a toner (composition) comprising toner particles and inorganic fine particles, and have not given consideration to the number-basis isolation percentage of organic fine particles and the number-basis isolation percentage of mother toner particles free from attachment of inorganic fine particles or organic fine particles in a toner (composition) further including such organic fine particles. Accordingly, the toners of these preceding references have left room for improvement with respect to environmental stability, uniform chargeability, cleanability, transferability and durability of toner.

SUMMARY OF THE INVENTION

Accordingly, a principal object of the present invention is to provide a toner containing organic fine particles and provided with overall improved performances with respect to environmental stability, uniform chargeability, cleanability, transferability and durability.

The toner of the present invention has been provided in order to achieve the above-mentioned object and comprises: a toner, comprising: toner particles including a polyester resin as a principal component, and at least a colorant and a charge control agent, and externally added inorganic fine particles and organic fine particles; the toner having a volume-average diameter of 4 to 10 μm, containing the charge control agent at 0.1 to 1.5%, and having an acid value of 2 to 33 mgKOH/g; the charge control agent exhibiting a number-basis isolation percentage of at most 10% with respect to the toner particles; the charge control agent, the inorganic fine particles and organic fine particles exhibiting number-basis isolation percentages from the toner particles satisfying a relationship shown below:

30%>inorganic fine particles>organic fine particles>charge control agent>0%.

The history of my study with the above-mentioned object until reaching the present invention is briefly supplemented. The understanding in the above-mentioned publications of JP-A 2002-72544 and JP-A 2003-270838 is correct in that the performances of a toner comprising toner particles containing a charge control agent and inorganic fine particles as an external additive are greatly affected by the number-basis isolation percentage from toner particles of the inorganic fine particles or of the inorganic fine particles and the charge control agent. However, in the case of a toner as a mixture system of a multiplicity of particles further including organic fine particles, the number-basis isolation percentage of the organic fine particles also greatly affects the toner performances. Particularly, even if the number-basis isolation percentage of the charge control agent is suppressed to be at most 10% as stipulated in the above-mentioned JP-A 2003-270838, inferior performances are caused with respect to fog, cleanability, transferability, etc., in the cases where the number-basis isolation percentage of the charge control agent is larger than the number-basis isolation percentage of the organic fine particles (Comparative Examples 3 and 6 later described), but these problems are remarkably improved if the number-basis isolation percentage of the charge control agent is smaller than the number-basis isolation percentage of the organic fine particles (Examples 7, 8 and 11). Further, if the toner particles free from attachment of the inorganic fine particles and the organic fine particles is within a specific range, the overall improvement in toner performances can be attained. The number-basis isolation percentages of the respective particles can be controlled by the selection of the acid value of the polyester resin as a principal binder resin, the charge control agent, the inorganic fine particles and the organic fine particles, and the selection of powder blend conditions. The toner of the present invention has been completed based on the above-mentioned knowledge.

Further, the toner of the present invention is effective particularly in the case where the charge control agent is a Zr-containing charge control agent. Thus, according to another aspect of the present invention, there is provided a toner, comprising: toner particles including a polyester resin as a principal component, and at least a colorant and a charge control agent, and externally added inorganic fine particles and organic fine particles; the toner having a volume-average diameter of 4 to 10 μm, containing the charge control agent at 0.1 to 1.5%, and having an acid value of 2 to 33 mgKOH/g; the charge control agent being a Zr-containing charge control agent and exhibiting a number-basis isolation percentage of at most 10% with respect to the toner particles.

DETAILED DESCRIPTION OF THE INVENTION

The toner of the present invention comprises: toner particles including a polyester resin as a principal constituent, and at least a colorant and a charge control agent; and inorganic fine particles and organic fine particles externally added to the toner particles.

The binder resin constituting the toner particles principally comprises a polyester resin. The polyester resin may be obtained by polycondensation of a polycarboxylic acid or a lower alkyl ester thereof and a polyhydric alcohol. Examples of the polycarboxylic acid or a lower alkyl ester thereof may include: aliphatic dibasic acids, such as malonic acid, succinic acid, glutaric acid, adipic acid and hexahydrophthalic anhydride; aliphatic unsaturated dibasic acids, such as maleic acid, maleic anhydride, fumaric acid, itaconic acid and citraconic acid; aromatic dibasic acids, such as phthalic acid, terephthalic acid and isophthalic acid; and methyl esters and ethyl esters of these. Among these, aromatic dibasic acids, such as phthalic acid, terephthalic acid and isophthalic acid, and lower alkyl esters thereof, are preferred.

Examples of the polyhydric alcohol may include diols, such as ethylene glycol, 1, 2-propylene glycol, 1, 3-propylene glycol, 1, 3-butylene glycol, 1, 4-butylene glycol, 1, 6-hexanediol, neopentyl glycol, diethylene glycol, dipropylene glycol, bisphenol A ethylene oxide-adduct; triols, such as glycerin, trimethylolpropane and trimethylolethane; mixtures of these. Among these, neopentyl glycol, trimethylolpropane, bisphenol A ethylene oxide-adduct, and bisphenol A propylene oxide-adduct, are preferred.

The polymerization may be effected by known methods of polycondensation, solution polycondensation, etc. As a result thereof, a good toner can be obtained without impairing the hue of a colorant for providing a color toner.

The binder resin may preferably comprise an above-mentioned polyester resin alone but can further include as a minor-quantity component another resin, such as polystyrene resin, styrene/acrylate copolymer resin, polyester-styrene/acrylate hybrid resin, epoxy resin, or polyether-polyol resin. It is preferred that the binder resin contains a polyester resin in a proportion of at least 60 wt. %, and exhibits an acid value of 2 to 33 mgKOH/g after the toner formation, so as to provide a stable chargeability in various environments.

If the acid value is below 2 mgKOH/g, the dispersibility of the charge control agent in the resin is lowered to localize the charge control agent in the toner composition, thereby lowering the strength thereat, so that the number-basis isolation percentage of the charge control agent through the pulverization is liable to be increased. Further, the resultant toner particles are liable to have a larger difference in charge among the individual particles, thereby resulting in a broad distribution of toner charges, whereby difficulties, such as fog and toner scattering, are liable to occur after printing on a large number of sheets. Further, as the resin becomes hard to result in a poor pulverizability, the production efficiency for attaining a prescribed particle size is lowered, thus causing an increase in production cost.

On the other hand, in case where the acid value is larger than 33 mgKOH/g, the resultant toner is liable to have a large moisture absorptivity, thus having unstable charges due to changes in humidity environments, and particularly in a high temperature-high humidity environment, the charge is lowered to cause difficulties, such as fog and toner scattering.

As for properties other than the acid value of the binder resin, with respect to color toners for providing a fixed image composed of superposed four colors, the transparency, anti-offset property and dispersibility of colorant are thought much of for respective colors of yellow, magenta and cyan, though they can be also used as mono-chromatic toners for a single color of development. For a black toner, the transparency and smoothness are not thought much of, but it becomes necessary to increase the melt-fusibility after the toner fixation and provide a moderate visco-elasticity for improving the anti-offset property, so that it is preferred to use a resin having a molecular weight and a softening point different from those of the resin for color toners.

More specifically, the resin usable for color toners may preferably have a weight-average molecular weight Mw of 10,000-180,000, a ratio Mw/Mn of 3-20 between the weight-average molecular weight Mw to the number-average molecular weight Mn, and a softening point in a range of 90-130° C. On the other hand, the resin usable for black toner may preferably have a weight-average molecular weight Mw of 10,000-150,000, a ratio Mw/Mn of 1-15 between the weight-average molecular weight Mw to the number-average molecular weight Mn, and a softening point in a range of 90-130° C. Further, for providing a black toner, it is possible to use a crystalline polyester resin in order to improve the fixing strength in a low temperature region.

In the present invention, an organo-metal complex is internally added into the toner particles as a charge control agent. As an element contained in such a charge control agent, Zr is preferred in view of high chargeability and environmental stability. Such a Zr-containing charge control agent may most preferably in the form of a Zr-complex of an alkyl-aromatic carboxylic acid, such as 3, 5-di-t-butyl-salicylic acid or 2-hydroxy-3-naphthoic acid. Further, the charge control agent used in the present invention may preferably have a number-average particle size of 0.1-8 μm, further preferably 0.1-6 μm, in order to achieve the number-basis isolation percentage prescribed in the present invention. Further, in order to achieve the number-basis isolation percentage of the present invention and attain a charge stability, the charge control agent may preferably be added in 0.1-5 wt. parts, more preferably 0.1-1 wt. part, per 100 wt. parts of the binder resin.

If the particle size is below 0.1 μm, the particles of the charge control agent dispersed in the toner is scarce at the surface layer part, so that the toner is liable to show a slow rise-up of charge and a lower saturated charge, thus failing to provide a sufficient charge stability and a sufficient charge in a high humidity environment. Accordingly, there are encountered difficulties, such as fog, toner scattering and extraordinarily high image density.

If the particle size is larger than 8 μm, the number of charge control agent particles liberated from the toner during the pulverization and classification increases, to result in an increased isolation percentage of the charge control agent, and finally it becomes difficult to produce toner particles which are smaller in size than the charge control agent particles, so that it becomes difficult to obtain a toner having a volume-average diameter of 4 to 10 μm.

As for the colorants used in the present invention, it is possible to use known dyes and pigments.

As yellow colorants, it is possible to use; condensed azo compounds, isoindolinone compounds, anthraquinone compounds, azo metal complexes, methane compounds and arylamide compounds as representative compounds. More specifically, it is suitable to use C.I. Pigment Yellow 12, 13, 14, 15, 17, 62, 74, 83, 93, 94, 95, 109, 111, 128, 129, 147, 168 or 180. Further, it is possible to co-use a dye, such as C.I. Solvent Yellow 93, 162 or 163.

As magenta colorants, it is possible to use: condensed azo compounds, diketopyrrolopyrrole compounds, anthraquinone compounds, quinacridone compounds, basic dye-lake compounds, naphthol compounds, benzimidazolone compounds, thioindigo compounds, perylene compounds, etc. More specifically, it is suitable to use C.I. Pigment Red 2, 3, 5, 6, 7, 23, 48:2, 48:3, 48:4, 57:1, 81:1, 144, 146, 166, 169, 177, 184, 185, 202, 206, 220, 221 or 254.

As cyan colorants, it is possible to use copper phthalocyanine compounds and derivatives thereof, anthraquinone compounds, basic dye-lake compounds, etc. More specifically, it is particularly suitable to use C.I. Pigment Blue 1, 7, 15, 15:1, 15:2, 15:3, 15:4, 60, 62 or 66.

These chromatic colorants may be used singly or in mixture, or in the form of a solid solution state.

As a black colorant, it is possible to use carbon black, a magnetic material or a combination of yellow/magenta/cyan pigments combined so as to provide black color. As a colorant for providing a black toner according to the present invention, it is preferred to use magnetite fine particles having a particle size of 0.1 μm or below, and in the case of using carbon black or a combination of pigments, it is preferred to further use an Fe-containing azo metal complex dye in combination therewith. A black colorant may be added in 1-20 wt. parts per 100 wt. parts of the resin.

The toner of the present invention may be used to provide a yellow toner, a magenta toner, a cyan toner and a black toner by using as colorants a yellow colorant, a magenta colorant, a cyan colorant and a black colorant, respectively, and such color toners in four colors may be used in combination to effect full-color image formation.

Within the toner particles, a wax may be added according to necessity, for the purpose of improving the ant-offset property at the time of fixation, adjusting the visco-elastic properties, etc. As the waxes added for such purposes, it is possible to use, e.g. natural waxes, such as rice wax and carnauba wax; petroleum waxes, such as paraffin wax; and synthetic waxes, such as aliphatic acid esters, aliphatic acid amides, low-molecular weight polyethylene and low-molecular weight polypropylene. The wax may ordinarily be added in a proportion of 1-10 wt. parts per 100 wt. parts of the binder resin.

Toner particles containing the components including the above-mentioned binder resin, charge control agent, colorant, wax added as desired, etc. may be produced through various processes. More specifically, there may be adopted toner production processes inclusive of, e.g., a process of well-kneading the constituent materials by a hot-kneading machine, such as hot rollers, a kneader or an extruder, mechanically pulverizing the kneaded product and classifying the pulverized powder to obtain a toner; a process of dispersing materials such as a colorant in a binder resin solution, followed by spray-drying; a suspension polymerization process of mixing prescribed materials with a polymerizable monomer for providing a binder resin to obtain a monomer composition and subjecting an emulsion or suspension liquid of the composition to polymerization, a dispersion polymerization process of directly producing a toner by using an aqueous organic solvent wherein the monomer is soluble but the resultant polymer is insoluble, or an emulsion polymerization process as represented by a soap-free polymerization process of producing a toner by direct polymerization in the presence of a water-soluble polar polymerization initiator; and a hetero-coagulation process of first preparing a primary polar emulsion polymerization particles and adding thereto polar particles having a charge of an opposite polarity. By effecting classification, as desired, after the particle formation, it is possible to obtain toner particles having a diameter of 4-10 μm in terms of a volume-average diameter (based on a particle size distribution measured by using a Coulter counter with a 100 μm-aperture (a lower limit of measurable diameter range: 1.26 μm) and suitable for use in the present invention.

In the toner of the present invention, inorganic fine particles are externally added onto the surfaces of the toner particles. The inorganic fine particles may be known ones. However, from the view point of imparting high flowability, high chargeability and high abrasive characteristic to the toner, titanium oxide and silica are particularly preferred. While the starting material and the production process for titanium oxide particles used in the present invention are not particularly restricted, it is preferred to use titanium oxide fine particles obtained by hydrophobizing titanium oxide particles produced by the sulfuric acid process. While the starting material and the production process for silica fine particles used in the present invention are not particularly restricted, it is preferred to use silica fine particles obtained by hydrophobizing silica particles produced by burning silicon tetrachloride at high temperatures.

It is preferred that the inorganic fine particles have a number-average primary particle diameter of at most 100 μm, preferably 10-100 μm and are added in a proportion of totally 0.3-10 wt. parts per 100 wt. parts of the toner particles. It is particularly preferred to use hydrophobized silica and titanium oxide in a weight mixture ratio of 10:1-5:10.

In the toner of the present invention, organic fine particles are externally added onto the surfaces of the toner particles. While such organic (or organometallic) fine particles may be know ones, metal soap fine particles are particularly preferred for the purpose of preventing the filming on the drum, reducing the spent toner and improving the transferability. The metal soap fine particles used in the present invention may include non-alkali metal salts of aliphatic acids, such as zinc stearate, calcium stearate and zinc laurate, and those containing metal elements of zinc and calcium are preferred. While the starting material and the production process for the metal soap fine particles are not particularly restricted, it is preferred to use those obtained through a direct process of directly reacting an aliphatic acid with a metal oxide or hydroxide or a double decomposition process of reacting an aliphatic acid alkali metal salt and a non-alkali metal salt in water to precipitate a metal soap, followed by pulverization of the resultant metal salt powder to a maximum diameter of at most 5 μm.

Incidentally, the particle sizes (diameters) of the charge control agent, inorganic fine particles and organic fine particles described herein are based on values measured by using a laser diffraction-type particle size distribution meter (e.g. "SALD-2000" made by Shimadzu Seisakusho, and "LA-700" made by K.K. Horiba Seisakusho).

According to the present invention, the number-basis isolation percentages of the above-mentioned charge control agent, inorganic fine particles and organic fine particles from the toner particles, and further the number-basis isolation percentages of toner particles (free from attachment of the inorganic fine particles of organic fine particles), are specified.

Herein, the number-basis isolation percentages of the charge control agent, inorganic fine particles and organic fine particles from the toner particles can be obtained by measuring number-basis isolation percentages of particular metal elements owned by the respective particles by means of a particle analyzer (PTI-1000", made by Yokogawa Denki K.K.). The measurement by using the particle analyzer is effected based on a principle described at pp. 65-68 of Japan Hardcopy 97 Papers. More specifically, according to the apparatus, fine particles such as those of a toner are introduced one by one into a high-temperature thermally non-equilibrium plasma having an electron density of $5\times10^{13}$ $cm^{-3}$, an excitation temperature of 3,300 K and a high electron temperature exceeding 20,000 K to excite the fine particles to cause a luminescence spectrum, from which it is possible to know the element, the number and particle diameter of the luminescent particles. Here, the number-basis isolation percentage of a fine particle containing an objective element is defined as a value calculated from a formula below based on the simultaneousness of luminescences from a carbon atom constituting the binder resin and from the objective element.

The isolation percentage of fine particles containing the objective element (%)=[A/(A+B)]×100, wherein A represents a number of luminescences from the objective element alone, and B represents a number of luminescences occurring simultaneously from the objective element and the carbon atom.

As a specific measurement method, helium gas containing 0.1% oxygen is introduced to effect the measurement in an environment of 23° C. and a humidity of 60%, channel 4 is used for measurement of carbon atom (measurement wavelength: 247.860 nm, K-factor: a value recommended for the apparatus), and channels 1, 2 and 3 (K values: recommended values for the apparatus) are used for measurement of the objective elements peculiar to the charge control agent, inorganic fine particles and organic fine particles, respectively. The measurement is performed by selection of the objective elements for the respective channels according the conditions recommended for the apparatus. Sampling is performed so that the number of luminescences of carbon atom amounts to 1,000±200 luminescences by one time of scanning by the apparatus, and the scanning is repeated until the total number of luminescences of carbon atom reaches 10,000 while integrating the luminescences. Based on the thus-measured data, the number-basis isolation percentages of the charge control agent, inorganic fine particles and organic fine particles with respect to the toner particles are respectively calculated according to the above-mentioned calculation formula.

Similarly, the number-basis isolation percentage of mother toner particles free from the attachment of the inorganic fine particles or organic fine particles is calculated by a formula shown below which is based on the simultaneousness of luminescences from a carbon atom constituting the binder resin and from the objective element contained in the inorganic fine particles or organic fine particles.

The isolation percentage of toner particles (%)=

$$[C/(C+D)]\times100,$$

wherein C represents a number of luminescences from carbon atom alone, and D represents a number of luminescences of the objective element occurring simultaneously with those from the carbon atom.

According to my study, the specification of the number-basis isolation percentage of each type of fine particles has the following meanings.

It is necessary that the charge control agent is present to some extent as isolated particles. More specifically, if the amount of the isolated particles of charge control agent is so few as to subside the detection lower limit (ca. 0.05% in terms of number-basis isolation percentage), the amount of charge control agent presented at the surface layer of toner particles is extremely small, so that it becomes difficult to attain a sufficient charge stability, thus being liable to result in a shortage of charge in a high humidity environment. As a result, there occur difficulties such as fog, toner scattering and extremely high image densities.

On the other hand, in case where the isolation percentage of charge control agent is higher than 10%, the amount of charge control agent isolated and released from the toner particle surfaces becomes excessively large. And, as the charge of the isolated and released charge control agent is remarkably high, there occurs a charge-up or excessive charge in a low-humidity environment. Further, after imaging on a large number of sheets, the isolated and released charge control agent attaches and sticks to the carrier surface, thus resulting in increased spent carrier to remarkably lower the charge-imparting ability of the carrier and provide an extremely broad toner charge distribution, leading to difficulties, such as fog, toner scattering, extremely high image density and toner filming on the drum.

If the isolation percentage of the inorganic fine particles is below 0.1%, in a later stage of an imaging test on a large number of sheets, fog increases and images become rough, particularly in a high temperature-high humidity environment. Generally, in a high-temperature environment, the embedding of external additives is liable to occur due to a stress exerted by a regulating member, etc., and the flowability of toner particles after printing on a large number of sheets becomes inferior to at the initial stage. This is believed to be a reason for the above problem.

On the other hand, if the isolation percentage of the inorganic fine particles exceeds 30%, the above problem hardly occurs, and the isolated inorganic fine particles exhibit an appropriate degree of spacer effect, thus providing a high transfer efficiency. However, because of a high isolation-percentage, it becomes difficult to attain an effect of reducing chargeability difference between different environments particularly depending on the humidity condition. As a result, the inorganic fine particles not readily held at the toner particles surfaces fail to jump from the developer-carrying member onto the photosensitive member but are liable to drop in clusters down to a lower part in the developing apparatus or soil the members involved in other process steps (such as charging, transfer and fixation), or cause another problem, such as the occurrence of hollow white image dropout in an image area due to attachment of the isolated and scattered inorganic fine particles onto unfixed images. Further, as the inorganic fine particles fail to attach onto the toner surface, they cannot effectively function to improve the long-term storage stability. As a result, particularly after storage for long period in a high-temperature environment, the toner particles coalesce each other until resulting in lumps or a block in an extreme case.

Further, in case where the isolation percentage of the organic fine particles is below 0.1%, the embedding and attachment or sticking of external additives onto the toner surface are liable to occur due to a stress exerted by a regulating member, etc., generally in a high-temperature environment, thus resulting in problems, such as a lowering in slippability of the photosensitive member surface or lowering in transferability, an increase of waste toner, and a lowering of image density due to decrease of toner quantity supplied to images. Further, in a process scheme including a recycle mechanism, the amount of the above-mentioned toner to which the external additive is embedded, attached or stuck, is increased in the developing apparatus, so that a sufficient charge stability cannot be attained in a later stage of imaging test on a large number of sheets, thus resulting in difficulties, such as fog and toner scattering.

On the other hand, if the isolation percentage of the organic fine particles exceeds 30%, the slippability on the photosensitive member surface is increased and the abrasion of the surface layer of the photosensitive member is decreased, thus effectively increasing the life of the photosensitive member. However, because of a high isolation percentage of organic fine particles, there occur difficulties such that the isolated and released organic fine particles attach and stick to the carrier surface to lower the charge-imparting ability of the carrier, and the excessive isolated organic fine particles attach and stick to the photosensitive drum to cause toner filming on the drum. Further, the isolated organic fine particles are liable to coalesce together to form lumps, which fall to a lower part in the developing apparatus or to images to result in image defects, such as gloss irregularity in image.

Further, in case where the isolation percentage of mother toner particles free from attachment of the inorganic fine particles is below 0.1%, such a toner including most of toner particles to which the inorganic fine particles are attached, shows an effective long-term storage stability and are free from calescence of the toner particles, but the exudability of the wax contained in the toner particles onto the toner surface when heated in the fixing step becomes inferior, thus resulting in difficulties, such as an inferior fixability and high-temperature offset.

On the other hand, if the isolation percentage of the toner mother particles free from attachment of the inorganic fine particles exceeds 15%, such a toner contains many particles free from surface attachment of inorganic fine particles, so that the uniform charging of the toner particles becomes difficult to result in a large difference in charge among individual particles and a broad toner charge distribution, thus resulting in difficulties, such as fog and toner scattering.

Further, in case where the isolation percentage of the toner particles free from attachment of the organic fine particles is less than 10%, such a toner contains many toner particles accompanied with surface-attached organic fine particles, and the toner particles are liable to attach and stick to the carrier surface when supplied with-a stress from the carrier, thus resulting in a lowering in charge-imparting ability of the carrier. Further, in the case of storage for a long period in a high-temperature environment, toner particles are liable to coalesce together until forming lumps or a block in an extreme case.

On the other hand, if the isolation particles of toner particles free from attachment of the organic fine particles exceeds 50%, many of these toner particles are free from the surface attachment of organic fine particles, thus being liable to result in difficulties, such as an increased surface layer abrasion of the photosensitive member surface due to a stress from the toner, a shorter life of the photosensitive member, and a toner filming on the drum due to attachment and sticking of the toner particles onto the photosensitive member surface.

According to the present invention, it is further preferred that the number-basis isolation percentages of the inorganic fine particles, organic fine particles and charge control agent satisfy the following relationship.

30%>inorganic fine particles>organic fine particles>charge control agent>0%.

The reason why the number-basis isolation percentage is preferably below 30%, is the same as described above. Unlike the case of JP-A 2003-270838, even if the number-basis isolation percentage of the charge control agent is as low as ca. 0.05% that is a lower detection limit, good toner performances can be attained (Examples 2-6, 9-10 and 12-15). This is because the Zr-containing charge control agent used in the present invention has a good charge-imparting ability and can impart a charge stability to the toner even if the amount of presence thereof at the toner particle surface layer is not so abundant as to provide a substantial amount of isolation of the charge control agent. Further, the co-present organic fine particles are considered to have a function of suppressing the isolation of the charge control agent. Further, even if the number-basis isolation percentage of the charge control agent is increased to some extent, good toner performances can be retained, if the number-basis isolation percentage of the organic fine particles is further larger. This is presumably because the difficulties caused by the isolation of the charge control agent are alleviated by the co-presence of the organic fine particles functioning to take up the isolated charge control agent. Further, if the number-basis isolation percentage of the organic fine particles is increased, the difficulties are liable to occur such that the lumps caused by coalescence of organic fine particles are dropped in clusters to a lower part of the developing apparatus to soil the interior of the machine and be transferred onto images, thus resulting in image defects, such as gloss irregularity of images, but such difficulties can be removed by the inorganic fine particles present in a dominant amount.

The above-mentioned prescribed number-basis isolation percentages of the respective fine particles can be achieved by appropriately adjusting the acid value of the binder resin, the addition amount of the charge control agent, and the external addition amount and the particle sizes of the inorganic fine particles and the organic fine particles, and further the external addition and mixing conditions.

The external addition and mixing of the inorganic fine particles and organic fine particles with the toner particles containing the charge control agent can be performed by commercially available powder mixing means, e.g., Henschel mixer, Proshear Mixer (made by Taiheiyo Kiko K.K.), Mixer & Granulator (made by K.K. Nara Kikai Seisakusho), Vertical Granulator (made by Powlec K.K.), High-Speed Mixer (made by Fukae Powlec K.K.), Turbulizer, Hemisphere Mixer (both made by Hosokawa Micron K.K.), Super Mixer (Kawata K.K.), Hemisphere Mixer (made by Sugiyama Juko K.K.) and Mechano-Hybrid (made by Mitsui Kozan K.K.). It is particularly preferred to use Henschel mixer. By increasing the environmental temperature and the time during the mixing, it is possible to effect a control in a direction of reducing the number-basis isolation percentages of the respective fine particles.

The thus-obtained toner according to the present invention can be used as a mono-component-type developer by itself but may preferably be combined with a carrier to form a two component-type developer wherein the number-basis isolation percentages of the respective fine particles are less liable to change even in a long period of use. In the case of using the toner according to the present invention as a two component-type developer in combination with a carrier, the carrier used may, for example, comprise surface-oxidized or unoxidized metals, such as iron, nickel, copper, zinc, cobalt, manganese, chromium and rare earth metals, and alloys and oxides of these metals, and ferrite. The production processes therefor are not particularly restricted. The surfaces of the carrier may be coated with a resin by any known methods, such as a method of coating a carrier with a coating material dissolved or dispersed in a solvent so as to attach the coating material onto the carrier or a method of simply blending with a powder. The coating materials on to the carrier surface may vary depending on the toner materials but may include, e.g., polytetrafluoroethylene, monochloro-trifluoroethylene polymer, polyvinylidene fluoride, silicone resin, polyester resin, metal complexes of di-tert-butylsalicylic acid, styrene resins, acrylic resins, polyamides, polyvinylbutyral, nigrosine, amino-acrylate resin, basic dyes and lake thereof, silica fine powder and alumina fine powder. These materials may be suitably used singly or in a plurality, but are not restricted thereto. A preferred form of carrier to be used in combination with the toner of the present invention may a ternary element ferrite, such as Cn—En—Fe or Mn—Mg—Fe, surface coated with silicone resin. The carriers may preferably have an average particle size of 10-100 μm, more preferably 20-70 μm.

EXAMPLES

Hereinbelow, the present invention will be described more specifically based on Examples and Comparative Examples. However, the present invention is not restricted to these Examples in any way. Incidentally, the amounts (part(s)) of the respective components described in Examples and Comparative Examples represent part(s) by weight.

Table 1 below shows binder resins used in respective Examples described below together with their physical properties of acid value, glass transition point and softening point.

Table 2 below shows various inorganic fine particles used together with their physical properties of primary particle size, BET specific surface area and hydrophobicity (i.e. wetting methanol concentration in aqueous methanol solution).

Table 3 shows various organic fine particles used together with their physical properties of particle size, metal content and melting point.

Table 4 shows colorants used.

Table 5 shows mixing conditions (i.e., apparatus and operation conditions thereof) used for external addition and mixing of inorganic fine particles and organic fine particles with toner particles.

TABLE 1

| Name | Resin | Acid value (mgKOH/g) | Tg (° C.) | Ts (° C.) |
|---|---|---|---|---|
| 1 | Polyester 1 | 3 | 60 | 110 |
| 2 | Polyester 2 | 30 | 65 | 120 |
| 3 | Polyester 3 | 20 | 61 | 115 |
| 4 | Polyester 4 | 1.9 | 59 | 115 |
| 5 | Polyester 5 | 55 | 59 | 115 |
| 6 | Styrene/Acryl resin | 0 | 60 | 120 |

TABLE 2

| Name | Inorganic fine particles | Primary particle size (nm) | BET specific surface area ($m^2/g$) | Hydrophobicity (%) |
|---|---|---|---|---|
| 1 | Silica 1 | 12 | 200 | 95 |
| 2 | Silica 2 | 30 | 50 | 95 |
| 3 | Titania 1 | 50 | 90 | 60 |
| 4 | Titania 2 | 30 | 200 | 60 |
| 5 | Alumina 1 | 15 | 170 | 65 |
| 6 | Alumina 2 | 300 | 5 | 65 |

TABLE 3

| Name | Organic fine particles | Particle size (μm) | Metal Content (%) | Tm (° C.) |
|---|---|---|---|---|
| 1 | Zn stearate | 4.5 | 11 | 120 |
| 2 | Ca stearate | 5 | 6.8 | 155 |

TABLE 4

| Name | Colorant |
|---|---|
| 1 | Carbon black + Fe-containing azo complex salt compound |
| 2 | Ferrite fine particles |

TABLE 4-continued

| Name | Colorant |
|---|---|
| 3 | Pigment Yellow 180 |
| 4 | Pigment Red 122 |
| 5 | Pigment Blue 15:3 |

TABLE 5

| | Mixing conditions | | | |
|---|---|---|---|---|
| Name | Mixing means | Revolution speed (m/s) | Time (min.) | Temp. (° C.) |
| 1 | Henschel mixer | 30 | 6 | 20 |
| 2 | Henschel mixer | 30 | 6 | 30 |
| 3 | Henschel mixer | 30 | 6 | 40 |
| 4 | Henschel mixer | 30 | 6 | 50 |
| 5 | Henschel mixer | 20 | 2 | 20 |
| 6 | Turbulizer | 20 | —* | 20 |

*instantaneous

Example 1

| | |
|---|---|
| Polyester resin 1 shown in Table 1 | 90 wt. parts |
| Colorant 5 shown in Table 1 | 5 wt. parts |
| Charge control agent (zirconium complex of di-t-butylsalicylic acid) | 1 wt. part |
| Rice wax | 4 wt. parts |

The above ingredients were preliminarily blended sufficiently by a Henschel mixer and melt-kneaded by a twin-screw extruding-kneading machine. After being cooled the kneaded product was coarsely crushed by a hammer mill, finely pulverized by an air jet-type pulverizer and classified to obtain cyan-colored toner particles having an average particle size of 7.9 μm, an acid value of 2 mgKOH/g and negative triboelectric chargeability.

100 wt. parts of the above toner particles, 0.5 wt. part of Inorganic fine particles 1 shown in Table 1, 2.5 wt. parts of Inorganic fine particles 2 shown in Table 2 and 0.25 wt. part of Organic fine particles shown in Table 3, were mixed under External addition and Mixing conditions 2 (i.e., mixed by means of a Henschel mixer at a mixing blade revolution speed of 30 m/sec in a mixing vessel at a temperature of 30° C. for a mixing time of 6 min.) to obtain a cyan toner.

The thus-obtained toner exhibited a number-basis isolation percentage of charge control agent with respect to the mother toner particles of 1.0%, a number-basis isolation percentage of inorganic fine particles with respect to the mother toner particles of 6.5%, a number-basis isolation percentage of organic fine particles with respect to the mother toner particles of 1.3%, a number-basis isolation percentage of mother toner particles free from attachment of inorganic fine particles of 6.8%, and a number-basis isolation percentage of mother toner particles free from attachment of organic fine particles of 39.6%.

The composition, volume-average diameter (particle size), acid value and external addition conditions are shown in Table 6 and the number-basis isolation percentages of the respective particles constituting the toner are shown in Table 7, respectively, together with the results of toners obtained in Examples described below.

Examples 2-15, Comparative Examples 1-8

Toners were prepared respectively in the same manner as in Example 1 except for using binder resins and colorants shown in Table 6 and adopting the addition amounts of charge control agent (zirconium complex of di-t-butylsalicylic acid), species and addition amounts of inorganic fine particles, species and addition amounts of organic fine particles and external addition and mixing conditions shown in Table 6.

In each Example, the amount of rice wax was the same as in Example 1, and the total amount of the components constituting the toner particle was adjusted to 100 wt. parts by compensating for the increase or decrease of the amount of the zirconium complex of di-t-butylsalicylic acid by decreasing or increasing the amount of the binder resin.

TABLE 6

| | | | Toner production conditions Mixing conditions | | | | | | | |
|---|---|---|---|---|---|---|---|---|---|---|
| | | | Toner | | Amount of | Inorganic fine particles | | Organic fine particles | | External addition & |
| Example | Resin | Colorant | Particle size (μm) | Acid value | charge control agent (%) | Name | Amount (parts) | Name | Amount (parts) | mixing conditions |
| 1 | 1 | 5 | 7.9 | 2 | 1.0 | 1/2 | 0.5/2.5 | 1 | 0.25 | 2 |
| 2 | 2 | 5 | 8.0 | 33 | 1.0 | 1/2 | 0.5/2.5 | 1 | 0.25 | 2 |
| 3 | 3 | 1 | 7.8 | 20 | 1.0 | 1/2 | 0.5/2.5 | 1 | 0.25 | 2 |
| 4 | 3 | 2 | 7.8 | 20 | 1.0 | 2/3 | 2.5/0.5 | 1 | 0.25 | 2 |
| 5 | 3 | 3 | 7.7 | 20 | 1.0 | 2/3 | 2.5/0.5 | 1 | 0.25 | 2 |
| 6 | 3 | 4 | 7.8 | 20 | 1.0 | 2/3 | 2.5/1.0 | 1 | 0.25 | 2 |
| 7 | 3 | 5 | 7.6 | 20 | 1.5 | 2/3 | 0.5/0.5 | 1 | 0.1 | 2 |
| 8 | 3 | 5 | 4.1 | 20 | 1.0 | 1/2 | 0.5/2.5 | 1 | 0.25 | 2 |
| 9 | 3 | 5 | 10.0 | 20 | 1.0 | 1/2 | 0.5/2.5 | 1 | 0.25 | 2 |
| 10 | 3 | 5 | 7.9 | 20 | 0.1 | 1/2 | 0.5/2.5 | 1 | 0.25 | 2 |
| 11 | 3 | 5 | 8.0 | 20 | 1.5 | 1/2 | 0.5/2.5 | 1 | 0.25 | 2 |
| 12 | 3 | 5 | 7.8 | 20 | 1.0 | 1/4 | 0.5/0.5 | 2 | 0.1 | 1 |
| 13 | 3 | 5 | 7.8 | 20 | 1.0 | 2/3/5 | 2.5/1.0/0.2 | 2 | 0.5 | 3 |
| 14 | 3 | 5 | 7.7 | 20 | 1.0 | 2/3 | 2.5/1.0 | 2 | 0.5 | 4 |
| 15 | 3 | 5 | 7.8 | 20 | 1.0 | 2/5 | 2.5/0.5 | 2 | 0.25 | 2 |
| Comp. 1 | 4 | 5 | 7.6 | 1.5 | 1.0 | 2/3 | 2.5/1.0 | 1 | 0.25 | 2 |

TABLE 6-continued

| | | | Toner production conditions Mixing conditions | | | | | | | |
|---|---|---|---|---|---|---|---|---|---|---|
| | | | Toner | | Amount of | Inorganic fine particles | | Organic fine particles | | External addition & |
| Example | Resin | Colorant | Particle size (μm) | Acid value | charge control agent (%) | Name | Amount (parts) | Name | Amount (parts) | mixing conditions |
| Comp. 2 | 5 | 5 | 7.7 | 50 | 1.0 | 2/3 | 2.5/1.0 | 1 | 0.25 | 2 |
| Comp. 3 | 6 | 5 | 7.7 | 0 | 1.0 | 2/3 | 2.5/1.0 | 1 | 0.25 | 2 |
| Comp. 4 | 3 | 1 | 7.8 | 20 | 0 | 1/4 | 0.5/0.5 | 2 | 0.1 | 2 |
| Comp. 5 | 3 | 1 | 7.6 | 20 | 2.0 | 1/4 | 0.5/0.5 | 2 | 0.1 | 2 |
| Comp. 6 | 3 | 5 | 7.6 | 20 | 2.0 | 1/4 | 0.5/0.5 | 1 | 0.1 | 2 |
| Comp. 7 | 3 | 5 | 7.7 | 20 | 1.0 | 1/6 | 0.5/2.5 | 1 | 0.25 | 5 |
| Comp. 8 | 3 | 5 | 7.8 | 20 | 1.0 | 1/6 | 0.5/2.5 | 1 | 0.25 | 6 |

TABLE 7

| Number-basis isolation percentages of the respective particles (%) | | | | | | |
|---|---|---|---|---|---|---|
| | | | | Total of all the | Toner particles | |
| Example | Charge control agent | Inorganic fine particles | Organic fine particles | external additives | Free from inorganic fine particles | Free from organic fine particles |
| 1 | 1.0 | 6.5 | 1.3 | 7.8 | 6.8 | 39.6 |
| 2 | 0.5 | 2.1 | 0.8 | 2.9 | 6.2 | 27.7 |
| 3 | 0.5 | 3.7 | 0.17 | 3.9 | 6.1 | 24.7 |
| 4 | 0.5 | 19.1 | 0.88 | 20.0 | 9 | 28.2 |
| 5 | 0.5 | 19.9 | 0.59 | 20.5 | 3.8 | 40.9 |
| 6 | 0.5 | 19.3 | 0.54 | 19.8 | 13.8 | 35.5 |
| 7 | 6.8 | 11.1 | 7.3 | 18.4 | 7.3 | 24.2 |
| 8 | 2.2 | 5.2 | 3.3 | 8.5 | 14.8 | 38.7 |
| 9 | 0.5 | 2.6 | 1.9 | 4.5 | 7.6 | 38 |
| 10 | 0.5 | 1.8 | 0.51 | 2.3 | 10.8 | 32 |
| 11 | 5.1 | 7.9 | 6 | 14.3 | 3.8 | 37.6 |
| 12 | 0.5 | 29.3 | 0.5 | 29.8 | 7.3 | 47 |
| 13 | 0.5 | 3.4 | 1 | 4.4 | 3.3 | 15.8 |
| 14 | 0.5 | 1.7 | 0.3 | 2.0 | 0.5 | 11.4 |
| 15 | 0.5 | 1.9 | 0.69 | 2.6 | 8.9 | 30.1 |
| Comp. 1 | 11.3 | 11.8 | 7.3 | 19.1 | 17.5 | 51.7 |
| Comp. 2 | 0 | 9.9 | 1.9 | 11.8 | 12.9 | 55.2 |
| Comp. 3 | 10.8 | 19.1 | 3.7 | 22.8 | 28.2 | 46.9 |
| Comp. 4 | 0 | 8.2 | 2.9 | 11.1 | 19.4 | 49.6 |
| Comp. 5 | 4.6 | 11 | 1.4 | 12.4 | 20.2 | 51.1 |
| Comp. 6 | 12.7 | 22 | 5.1 | 27.1 | 16.4 | 59.5 |
| Comp. 7 | 0 | 22 | 2.7 | 24.7 | 24.2 | 68.6 |
| Comp. 8 | 0 | 24 | 2.8 | 26.8 | 21.5 | 67.1 |

Toner Performance Evaluation Tests

A toner obtained in each of the above Examples and a silicone resin-coated carrier having an average particle size of 40 μm were blended so as to obtain a toner concentration of 8 wt. %, thereby providing a developer. The developer was charged in a color copying machine ("e-STUDIO4511", made by Toshiba TEC K.K.) and used for continuous imaging on 20000 sheets while replenishing the toner as required in each of a high temperature-high humidity environment (HH: 35° C., 85% RH) and a low temperature-low humidity environment (LL: 10° C., 20% RH) with an original having an image-areal percentage of 25%. The results of the evaluation and the result of high-temperature storability evaluation are shown in Table 8.

The evaluation method and standard for each of the evaluation items shown in Table 8 are described below.

Charge(ability) change was evaluated based on a difference between the charge at the initial stage and after imaging on 20000 sheets, and a smaller difference represents a better toner performance. The evaluation standard is as follows: A: less than 1 μC/g, B: 1-5 μC/g, C: 5-10 μC/g, D: 10 μC/g or more.

ID change was evaluated based on a difference between the image density at the initial stage and the image density after imaging on 20000 sheets, and a smaller difference represents a better toner performance. The evaluation standard is as follows: A: less than 0.1, B: 0.1-0.15, C: 0.15-0.2, D: 0.2 or more.

Fog was evaluated based on a worst value (maximum) during the imaging on 20000 sheets, and a smaller fog value represents a better toner performance. A: below 1.0%, B: 1.0-2.0%, C: 2.0-5.0%, D: 5.0% or higher.

Cleanability was evaluated based on the result of observation with eyes of the surface state of the photosensitive member after the imaging on 20000 sheets. A: No toner attachment or scar was found. B: Several attachments or scars were observed but resulted in no image defects. C: Ten or more attachments or scars were observed and resulted in observable image defects. D: Resulted in conspicuous image defects.

Transferability was evaluated based on a worst value (minimum) during the imaging on 20000 sheets, and a larger value represents a better toner performance. A: 95% or higher, B: 95-90%, C: 90-80%, D: below 80%.

High-temperature storability was evaluated by a test wherein 20 g of a sample toner was charged in a polyethylene bottle and left standing for 200 hours in an environment of 45° C., and the content was sieved through a 60 mesh-sieve to measure a weight of toner having lost the flowability and remaining on the sleeve. A smaller value represents a better toner performance. A: 0-5 g, B: 5-10 g, C: 10-15 g, D: 15-20 g.

TABLE 8

| | Toner performance evaluation results | | | | | | | | | | |
|---|---|---|---|---|---|---|---|---|---|---|---|
| | High temperature-high humidity environment | | | | | Low temperature-low humidity environment | | | | | High- |
| Example | Charge change | ID Change | Fog | Cleanability | Trans-ferability | Charge change | ID Change | Fog | Cleanability | Transferability | temperature storability |
| 1 | B | A | A | A | A | B | A | A | A | A | A |
| 2 | B | A | B | A | A | B | A | B | A | A | A |
| 3 | A | A | B | A | A | A | A | B | A | A | A |
| 4 | A | A | A | A | A | A | A | A | A | A | A |
| 5 | A | A | B | B | A | A | A | B | B | A | B |
| 6 | A | A | C | B | A | A | A | B | B | A | B |
| 7 | B | A | C | B | B | C | A | B | B | B | A |
| 8 | B | A | B | A | A | B | A | B | A | A | A |
| 9 | A | A | B | A | A | A | A | B | A | A | A |
| 10 | A | A | A | A | A | A | A | A | A | A | A |
| 11 | B | A | A | A | A | A | A | A | A | A | A |
| 12 | A | A | A | A | B | A | A | A | A | B | B |
| 13 | A | A | A | B | B | A | A | A | B | B | B |
| 14 | A | A | A | A | A | A | A | A | A | A | A |
| 15 | A | A | A | A | A | A | A | A | A | A | B |
| Comp. 1 | C | A | B | D | B | B | A | B | C | C | D |
| Comp. 2 | D | D | D | C | B | C | B | C | C | B | C |
| Comp. 3 | D | C | D | D | D | D | B | C | D | B | D |
| Comp. 4 | C | D | C | C | C | C | C | B | C | C | B |
| Comp. 5 | B | B | B | C | B | B | B | B | C | C | C |
| Comp. 6 | B | B | B | D | B | D | B | B | D | D | D |
| Comp. 7 | B | B | D | C | B | B | B | B | D | B | C |
| Comp. 8 | B | C | D | C | B | B | B | B | B | C | C |

In view of the evaluation results shown in Table 8 with reference toner composition, etc. shown in Table 6 and the data of number-basis isolation percentages of the constituent fine particles shown in Table 7, it is understood that the toners of the present invention which comprised toner particles containing a charge control agent and inorganic and organic fine particles externally added thereto and were obtained by specifying the number-basis isolation percentages of the charge control agents, inorganic fine particles and organic fine particles in addition to the volume-average diameter, acid value and the content of the charge control agent, exhibited stable performances with respect to charge (ability), image density, fog, cleanability and transferability in continuous imaging tests on large numbers of sheets in both high temperature-high humidity environment and low temperature-low humidity environment, and also excellent storability at high temperature (45° C.).

What is claimed is:

1. A toner, comprising: (1) toner particles comprising a polyester resin as a principal component, a colorant, and a charge control agent; (2) externally added inorganic fine particles; and (3) externally added metal-containing organic fine particles;

the toner having a volume-average diameter of 4 to 10 μm, containing the charge control agent at 0.1 to 1.5%, and having an acid value of 2 to 33 mg KOH/g;

the charge control agent exhibiting a number-basis isolation percentage of at most 10% with respect to the toner particles; and the charge control agent, the inorganic fine particles and organic fine particles exhibiting number-basis isolation percentages from the toner particles satisfying a relationship shown below: 30%>inorganic fine particles>organic fine particles>charge control agent>0%.

2. A toner according to claim 1, wherein the charge control agent, the inorganic fine particles and the organic fine particles exhibit number-basis isolation percentages from the toner particles satisfying a relationship shown below:

inorganic fine particles>organic fine particles>charge control agent≧0.05%.

3. A toner according to claim 1, wherein the externally added inorganic fine particles have been hydrophobized and contain Si, Ti or Al, the externally added organic fine particles contain either Zn or Ca, and each external additive exhibits a number-basis isolation percentage of 0.1 to 30%.

4. A toner according to claim 1, wherein the charge control agent is a Zr-containing charge control agent.

5. A toner according to claim 1, wherein the inorganic fine particles have primary particle sizes of 1-100 nm, and particles having a larger particle size exhibit a larger number-basis isolation percentage than particles having a smaller particle size.

6. A toner according to claim 1, wherein the toner particles include 0.1 to 15% by number of particles free from attachment of the inorganic fine particles and 10 to 50% by number of particles free from attachment of the organic fine particles.

7. A toner according to claim 1, containing a colorant selected from the group consisting of yellow colorant, magenta colorant, cyan colorant and black colorant, and being used for forming full color images by combination of a yellow toner, a magenta toner, a cyan toner and a black toner.

8. A toner according to claim 7, wherein the black toner contains an Fe-containing colorant.

9. A toner according to claim 1, wherein the metal-containing organic fine particles comprise metal soap fine particles.

10. A toner according to claim 9, wherein the metal soap fine particles comprise a non-alkali metal salt of an aliphatic acid.

11. A toner according to claim 10, wherein the non-alkali metal salt of an aliphatic acid is selected from the group consisting of zinc stearate, calcium stearate and zinc laurate.

12. A toner, comprising: (1) toner particles comprising a polyester resin as a principal component, a colorant, and a charge control agent; (2) externally added inorganic fine particles; and externally added metal-containing organic fine particles;

the toner having a volume-average diameter of 4 to 10 μm, containing the charge control agent at 0.1 to 1.5%, and having an acid value of 2 to 33 mg KOH/g;

the charge control agent being a Zr-containing charge control agent and exhibiting a number-basis isolation percentage of at most 10% with respect to the toner particles.

13. A toner according to claim 12, wherein the externally added inorganic fine particles have been hydrophobized and contain Si, Ti or Al, the externally added organic fine particles contain either Zn or Ca, and each external additive exhibits a number-basis isolation percentage of 0.1 to 30%.

14. A toner according to claim 12, wherein the charge control agent, the inorganic fine particles and organic fine particles exhibiting number-basis isolation percentages from the toner particles satisfying a relationship shown below: 30%>inorganic fine particles>organic fine particles>charge control agent>0%.

15. A toner according to claim 12, wherein the inorganic fine particles have primary particle sizes of 1-100 nm, and particles having a larger particle size exhibit a larger number-basis isolation percentage than particles having a smaller particle size.

16. A toner according to claim 12, wherein the toner particles include 0.1 to 15% by number of particles free from attachment of the inorganic fine particles and 10 to 50% by number of particles free from attachment of the organic fine particles.

17. A toner according to claim 12, containing a colorant selected from the group consisting of yellow colorant, magenta colorant, cyan colorant and black colorant, and being used for forming full color images by combination of a yellow toner, a magenta toner, a cyan toner and a black toner.

18. A toner according to claim 17, wherein the black toner contains an Fe-containing colorant.

19. A toner according to claim 12, wherein the metal-containing organic fine particles comprise metal soap fine particles.

20. A toner according to claim 19, wherein the metal soap fine particles comprise a non-alkali metal salt of an aliphatic acid.

* * * * *